United States Patent [19]

Ely

[11] Patent Number: 4,884,605

[45] Date of Patent: Dec. 5, 1989

[54] LATHE CHARGER CENTERING WITH LOG SCANNING DURING ROTATION AND LATERAL MOVEMENT OF SPINDLES

[75] Inventor: Gary W. Ely, Canby, Oreg.

[73] Assignee: The Coe Manufacturing Company, Painesville, Ohio

[21] Appl. No.: 306,473

[22] Filed: Feb. 3, 1989

[51] Int. Cl.[4] ..... B27B 1/00

[52] U.S. Cl. ..... 144/357; 144/209 A; 336/372; 336/385; 336/5; 364/559; 364/561

[58] Field of Search ..... 364/561, 559; 356/5, 356/1, 372, 385; 144/209 R, 209 A

[56] References Cited

U.S. PATENT DOCUMENTS

| | | | |
|---|---|---|---|
| 3,852,579 | 12/1974 | Sohn et al. | 235/151.3 |
| 4,197,888 | 4/1980 | McGee et al. | 144/209 A |
| 4,245,735 | 1/1981 | Valo | 198/492 |
| 4,248,532 | 2/1981 | Nosler | 356/1 |
| 4,335,763 | 6/1982 | McGee | 144/209 A |
| 4,383,560 | 5/1983 | McGee | 144/209 A |
| 4,412,297 | 10/1983 | Halgrimson et al. | 364/559 |
| 4,737,031 | 4/1988 | Mahlberg et al. | 144/209 A |

*Primary Examiner*—W. Donald Bray
*Attorney, Agent, or Firm*—Klarquist, Sparkman, Campbell, Leigh & Whinston

[57] ABSTRACT

Aa veneer lathe charger and method of operation to center logs for transfer to a veneer lathe to obtain optimum yield of wood veneer at a higher production rate up to 15 logs per minute is described. The method includes scanning the log to determine its optimum yield axis while the log is being rotated and moved laterally toward a transfer position and adjusting the position of the log spindles to align the optimum yield axis with a lathe reference axis at such transfer position for transfer to the veneer lathe axis.

20 Claims, 9 Drawing Sheets

LATHE CHARGER CENTERING WITH LOG SCANNING DURING ROTATION AND LATERAL MOVEMENT OF SPINDLES

BACKGROUND OF INVENTION

The present invention relates generally to the centering of logs in a veneer lathe charger to obtain an optimum yield of wood veneer from such logs when they are peeled in a veneer lathe and, in particular, to methods of centering a log in a veneer lathe charger which includes scanning the log during rotation and lateral movement of such log toward a transfer position while it is engaged by spindles, determining the optimum yield axis from the scan data, and adjustment of the spindles to align the optimum yield axis with a lathe reference axis at such transfer position for transfer to the veneer lathe axis.

It has been previously proposed in U.S. Pat. No. 3,852,579 of Sohn, et al., issued Dec. 3, 1974, to provide a computer-controlled veneer lathe charger for centering logs using light reflection scanning as the logs are rotated by spindles to determine the surface configuration of the logs. The log spindles are not moved laterally during scanning but are adjusted by a digital computer control system to reposition the log subsequent to scanning after the computer determines the optimum spin axis of the log from the scan data.

In a veneer lathe charger manufactured by The Coe Manufacturing Company, Painesville, Ohio, the logs are first rough-centered mechanically by three centering arms at each end of the log and then rotated by spindles about the rough center axis while scanning to determine the optimum yield axis of the log with a computer, as shown in U.S. Pat. No. 4,197,888 of McGee, et al., issued Apr. 15, 1980. After scanning, the spindles on which the log is rotated are adjusted horizontally and vertically to reposition the log until its optimum yield axis is aligned with a lathe reference axis at a transfer position. The aligned log is engaged by support arms, such as pendulum arms, at the transfer position for transfer of the log from the lathe charger to the veneer lathe axis for peeling. To avoid the high cost of mechanical centering, it has been previously proposed in the Type 784 lathe charger of Coe to rough-center the log by first scanning the log in a rest position with light sensors to determine its approximate center axis. The log is moved from the rest position to a rotating scan position where the ends of the log are engaged with spindles at such approximate center axis and then the log is rotated on such spindles during a second scanning to determine its optimum yield axis. After this scanning, the spindles are adjusted to align the optimum yield axis and the log is moved to a transfer position. Unfortunately, movement from the rest position to the rotating scan position takes a long time, thereby reducing the number of logs which can be centered in a given time period.

The above problems are overcome by the method of centering a log in a veneer lathe charger in accordance with the present invention. The approximate center axis of the log is determined by scanning the log while it is in a rest position as the spindles are lowered toward the rest position to determine its approximate center axis. The spindles engage the opposite ends of the log at such approximate center axis for rotation of such log. Then, the log is scanned with light sensors or other noncontact scanners as such log is being rotated and moved laterally from the rest position upward toward a transfer position. During lateral movement of the log toward the transfer position, the optimum yield axis of the log is determined from the scan data and the spindles are adjusted to align the optimum yield axis with a lathe reference axis at the transfer position for transfer to the veneer lathe axis. This method is extremely efficient in reducing the amount of time required for centering and in producing accurate centering. Thus, in one embodiment of the invention, 15 log blocks a minute can be centered, or one block every 4 seconds, which is an increase in production of approximately 25 percent over prior methods which scan the log as it is being rotated without any lateral movement of the log during scanning, as is done in the assignee's Type 784 lathe charger.

It has previously been proposed in U.S. Pat. No. 4,248,532 of Nosler, issued Feb. 3, 1981, to scan logs with image displacement-type light reflection scanners spaced longitudinally along the log. These light-reflection scanners are preferably used for the scanning steps in the method of the present invention for greater accuracy. However, other types of noncontact scanning can also be employed, including shadow or occlusion light scanning such as shown in U.S. Pat. No. 4,197,888 of McGee, issued Apr. 15, 1980, or acoustical scanning using ultrasonic transducers, as shown in U.S. Pat. No. 4,412,297 of Hälgrimson, et al., issued Oct. 25, 1983.

Also, the lathe charger and method of the present invention uses a "Singulator" type of log conveyor device for separating logs, for feeding them one at a time into the rest position where they are rough scanned, and for discharging any rejected logs in a rapid, simple, and trouble-free manner. As shown in U.S. Pat. No. 4,245,735 of Valo issued Jan. 20, 1981, such Singulator devices have previously been used for transferring logs but not to support a log in a lathe charger while the log is being rough-scanned in the manner of the present invention.

SUMMARY OF INVENTION

It is one object of the present invention to provide an improved method of centering a log in a veneer lathe charger more efficiently and faster for greater production.

Another object of the invention is to provide an improved veneer lathe charger and method of operation in which the log is scanned by noncontact sensors during rotation and lateral movement of the log toward a transfer position in order to determine the optimum yield axis of such log and to align such axis at the transfer position for transfer to the veneer lathe axis in a faster manner.

A further object of the invention is to provide such an improved lathe charger and method in which the log is rough-centered by scanning the log in a rest position as spindles are moved downward toward such rest position and for engaging the opposite ends of the log with such spindles at the approximate center axis of the log to rotate such log during subsequent scanning for more accurate determination of the optimum yield axis and for reducing the cost of the charger by eliminating the need for mechanical rough-centering.

An additional object of the invention is to provide such an improved lathe charger and method of operation in which a Singulator device is employed for feeding logs into the charger one at a time and for holding the logs in a rest position while they are being scanned, as well as for discharging any rejected logs after rough scanning for more efficient operation of the charger and to reduce the time required for rejecting unsatisfactory logs.

Still another object of the invention is to provide a method for centering logs in a veneer lathe charger which increases the speed and accuracy of operation of such charger employing light scanning for both rough-centering and for determining the optimum yield axis of the log as the spindles for rotating the log are being moved laterally.

A still further object of the invention is to provide an improved method of centering a log in a veneer lathe charger in which the log is moved laterally from a rest position toward a transfer position as the log is being rotated and scanned, as the optimum yield axis is determined from the scan data, and as the log is being adjusted to align its optimum yield axis with a lathe reference axis at the transfer position.

DESCRIPTION OF DRAWINGS

Other objects and advantages of the present invention will be apparent from the following detailed description of a preferred embodiment thereof and from the attached drawings, of which.

DESCRIPTION OF PREFERRED EMBODIMENT

Figure 1:
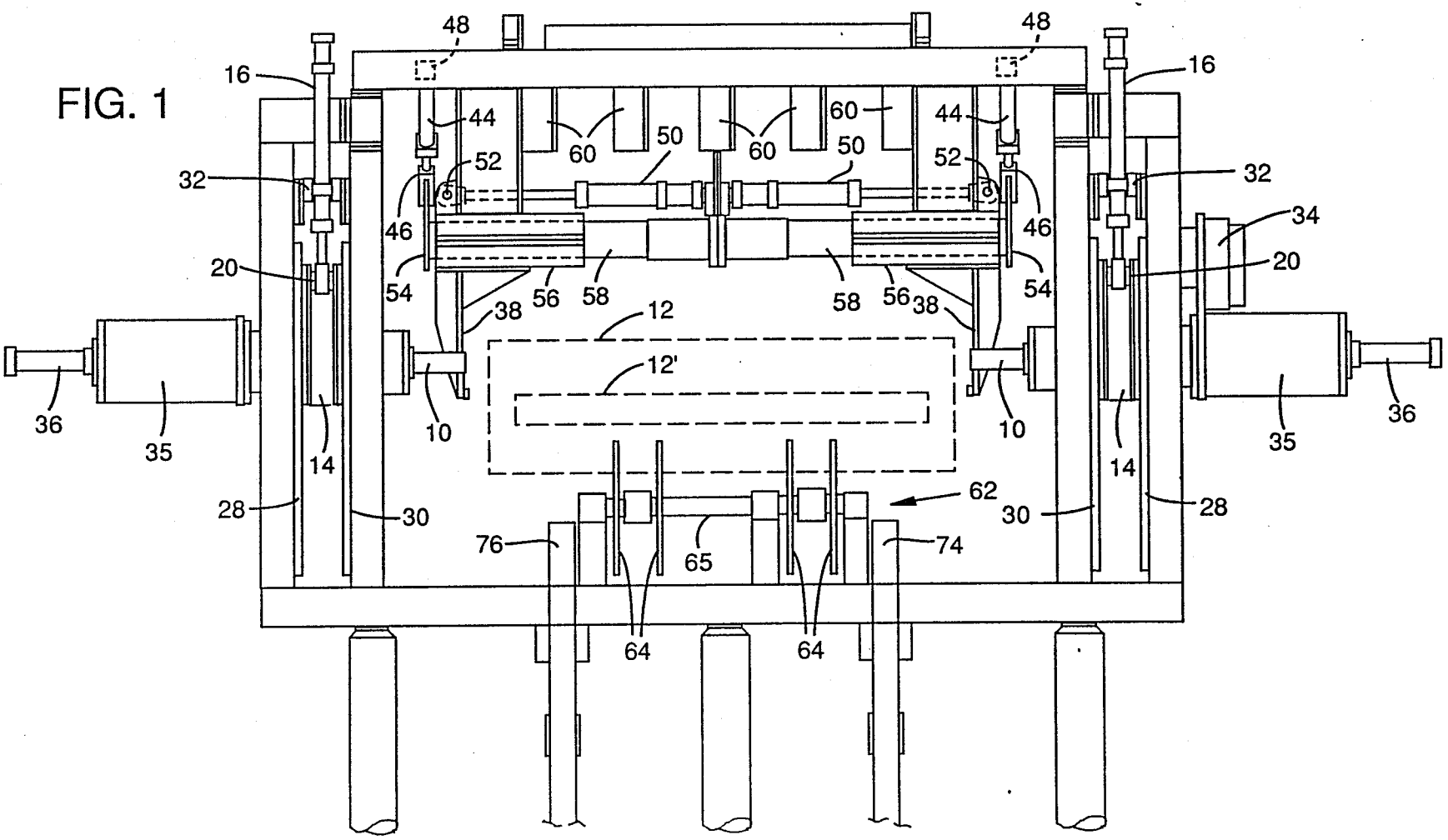
FIG. 1 is a front elevation view of a lathe charger apparatus in accordance with the present invention.
Figure 2:
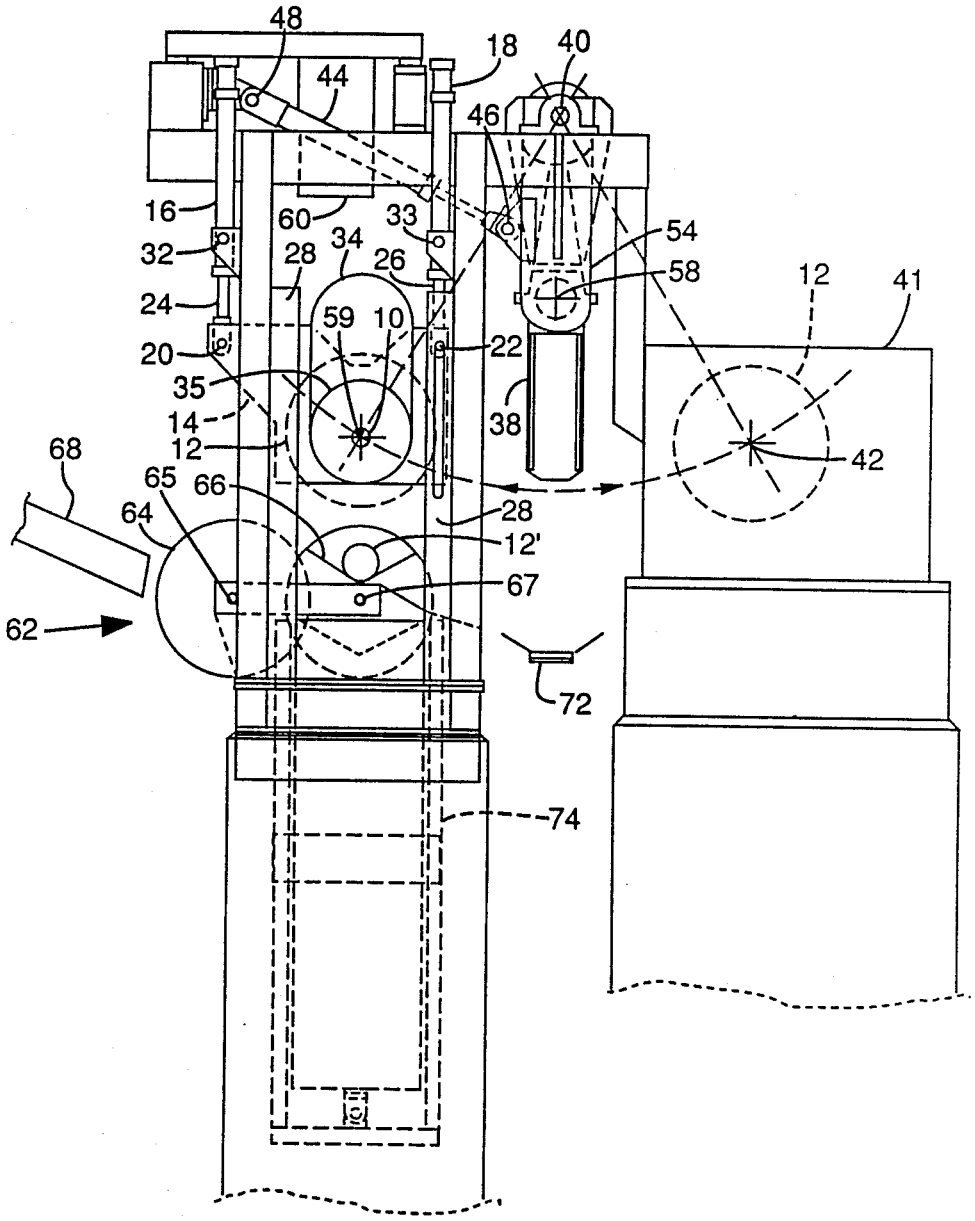
FIG. 2 is a side elevation view of the apparatus of FIG. 1 showing how a log is transferred to the veneer lathe.

As shown in FIGS. 1 and 2, a veneer lathe charger, in accordance with the present invention, includes two scanning spindles 10 which are supported adjacent the opposite ends of a log 12 by a pair of spindle supports 14. The spindle supports 14 may be of the pivoting and longitudinal movement type shown in U.S. Pat. No. 4,335,763 of McGee which issued June 22, 1982. The spindle supports 14 are each raised and lowered by a pair of longitudinal positioners 16 and 18 which are pivotally connected to the spindle support 14 at its upper left and right corners by pivots 20 and 22, respectively. As a result of longitudinal movement of piston rods 24 and 26 of the positioners 16 and 18, respectively, the spindle carriage 14 will move vertically and may also pivot about pivots 20 and 22 if such piston rods are raised and lowered by unequal amounts. Thus, the longitudinal positioners provide both vertical and horizontal adjustment of the spindles 10 in two orthogonal directions. The positioners may be of the electrohydraulic type, including a servo valve operated by an analog output of a computer to control the flow of hydraulic fluid into the cylinder for accurately positioning the piston rod. However, other suitable linear positions can be employed, including those of the jackscrew type operated by an electric motor. The vertical movement of each spindle support 14 is guided by two pairs of vertical guides 28 and 30 between which such spindle support slides. The pivot connection 22 of the spindle support may be held within a vertical slot in the rear of one of guides 28 to enable pivoting and vertical movement of the spindle support as shown in U.S. Pat. No. 4,335,763. The longitudinal positioners 16 and 18 are each pivotally mounted to the charger frame at pivots 32 and 33, respectively.

At least one of the spindles 10 is coupled to servo-controlled hydraulic drive motor 34 which rotates such spindle in a precisely accurate manner under the control of a computer to cause the log block to be rotated through one or two complete 360 degree revolutions during scanning. The spindles 10 are moved from their retracted positions shown in FIG. 1 outward of spindle housings 35 to an extended position in engagement with the opposite ends of the log 12 at the approximate center axis of such log by means of hydraulic cylinders 36, also controlled by the computer control system. The spindle housings 35 are mounted on the spindle supports 14 for movement with such spindle supports.

A pair of transfer arms 38 are mounted for pivotal movement on a common support shaft 40 to act as pendulums for transferring the log 12 from the lathe charger to a veneer lathe 41 where such log is peeled during rotation about lathe axis 42, as shown in FIG. 2. The pivoting of the pendulum transfer arms 38 is accomplished by means of a pair of pendulum cylinders 44 having their piston rods pivotally connected at pivots 46 to beam supports 54 attached to the opposite ends of a support beam 58 for the transfer arms. The upper end of the pendulum cylinders 44 is pivotally connected at pivot 48 to the lathe charger frame. The transfer arms are moved inwardly from the retracted position shown in FIG. 1 to a clamped position in engagement with the opposite ends of the log by means of two clamp cylinders 50 whose piston rods are connected to the transfer arms at connections 52. The transfer arms 38 are fastened to sleeves 56 which slide on the support beam 58 held by beam supports 54 as shown in FIG. 1. Thus, clamp cylinders 50 cause the transfer arms 38 to move into engagement with the opposite ends of the log to clamp such log at a transfer position where the optimum yield axis of the log is aligned with a lathe reference axis 59 corresponding to the lathe axis 42 but spaced therefrom by an arcuate displacement of the transfer arms of about 60 degrees. The transfer arms 38 are pivoted by the computer control system actuating pendulum cylinders 44 to move the log from the transfer position of reference axis 59 to the lathe axis 42 for peeling veneer from the log when the lathe spindles engage and rotate the log at such lathe axis.

A plurality of noncontact sensors 60 are supported above the spindles 10 and transfer arm at positions spaced along the length of the log 12 to scan the log at rest and as such log is rotated by the spindles. For example, five sensors 60 are employed for scanning a log of a maximum length of 106 inches, each sensor separated from its adjacent sensor by a distance of approximately 21 inches, center to center. While the scanners 60 may be any suitable noncontact log sensor, they are, preferably, light-reflection sensors of the image-displacement type, each including a laser light source and a linear diode array photoelectric detector, as shown in U.S. Pat. No. 4,248,532 of Nosler, issued Feb. 3, 1981. However, they may also be of an acoustical sensor type such as the ultrasonic transducers shown in U.S. Pat. No.

4,412,297 of Halgrimson, et al., issued Oct. 25, 1983. Also, the sensors 60 may be of a light-occlusion or shadow type optical sensors such as that shown in U.S. Pat. No. 4,197,888 of McGee, issued Apr. 15, 1980.

It should be noted that, while large logs 12 up to a maximum size on the order of 30 inches in diameter and 106 inches in length may be scanned in the lathe charger of the present invention, smaller logs, down to a minimum size of approximately 6 inches in diameter and 94 inches in length, indicated by reference numeral 12', may also be scanned accurately with the lathe charger of FIGS. 1 and 2. Such logs are fed into the lathe charger by a Singulator type rotating conveyor device 62, as described in U.S. Pat. No. 4,245,735 of Valo, issued Jan. 20, 1981.

Figure 4A:
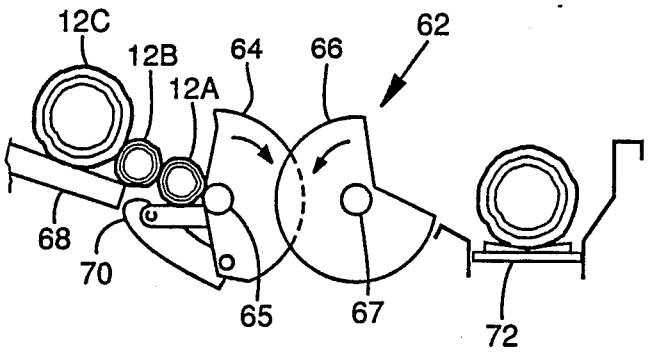
FIGS. 4A to 4D are diagrammatic views showing the operation of the log feeder for the lathe charger of FIGS. 1 and 2.
Figure 4B:
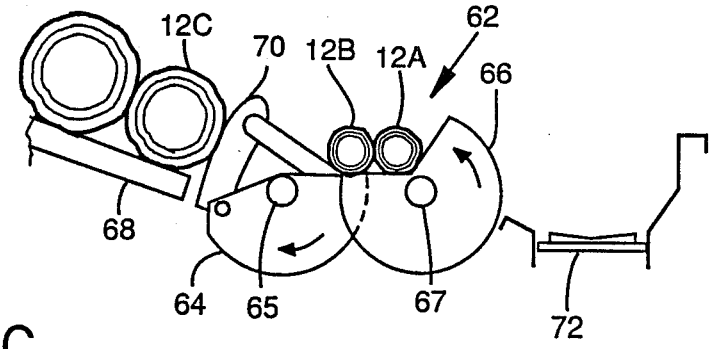
Figure 4C:
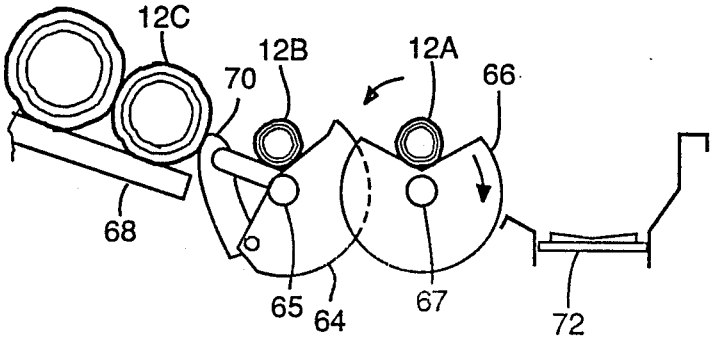
Figure 4D:
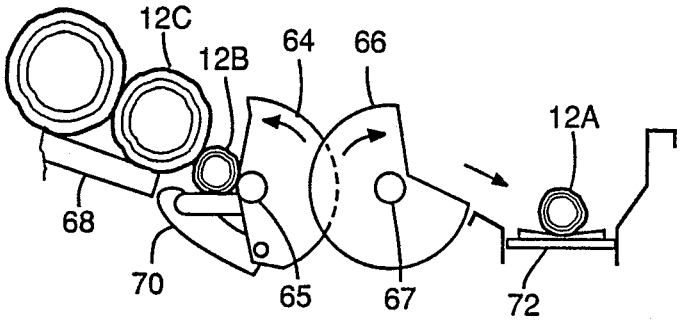

The Singulator conveyor device separates logs and feeds logs into the lathe charger apparatus one at a time. The Singulator conveyor device includes four pairs of rotatable disks, each including an input disk 64 which rotates on shaft 65 and an output disk 66 which rotates on shaft 67. The operation of the Singulator device is shown in FIGS. 4A to 4D. Thus, a plurality of logs 12 are fed down an infeed ramp 68 into the Singulator device so that one of the logs is engaged by the input disks 64. The input disks 64 rotate clockwise approximately 90 degrees from the position of FIG. 4A to that of FIG. 4B, while the output disks 66 rotate counterclockwise approximately 90 degrees, so that the first log 12A on the input disk is transferred to the output disk. A stop 70 on the input disk prevents the third log 12C from reaching the input disk 64. In FIG. 4C, input disk 64 rotates back counterclockwise approximately 45 degrees to separate the second log 12B from the first log 12A which is captured by the output disk 66. The output disk 66 rotates clockwise about 45 degrees so that the first log 12A is held in the V-shaped notch in the top of such output disk. In FIG. 4C, the log 12A is held in a rest position by disks 66 for rough centering while the scanners 60 scan such log to provide scan data of the log's dimensions to enable its approximate center axis to be determined by means of a digital computer. If the log is determined to be acceptable, the spindles 10 are moved completely down to the rest position by the spindle supports 14 and such spindles are extended into engagement with the opposite ends of the log at the approximate center axis. Then such log is lifted upward by the spindle supports 14 toward the transfer position 59 while the spindles are being rotated and the log is being further scanned to determine its optimum yield axis. However, if the log is determined by the rough centering scan to be unacceptable, the scanning spindles do not move into engagement with such log. Instead, as shown in FIG. 4D, the output disk 66 rotates clockwise approximately another 45 degrees to dump the log onto a discharge conveyor 72. The discharge conveyor moves the log longitudinally away from the lathe charger. The input disk 64 also rotates about 45 degrees counterclockwise back to its initial position and the next log 12B is engaged and separated by the Singulator conveyor in a similar manner.

It should be noted that a pair of centering "V" members 74 and 76 are also provided in FIGS. 1 and 2 below the Singulator conveyor device 62 in order to mechanically rough center the logs to allow the lathe chager to continue to operate when the scanner 60, the spindles 10, or the computer control system for determining the optimum yield axis and for adjustment of the spindles 10 is not functioning.

Figure 3A:
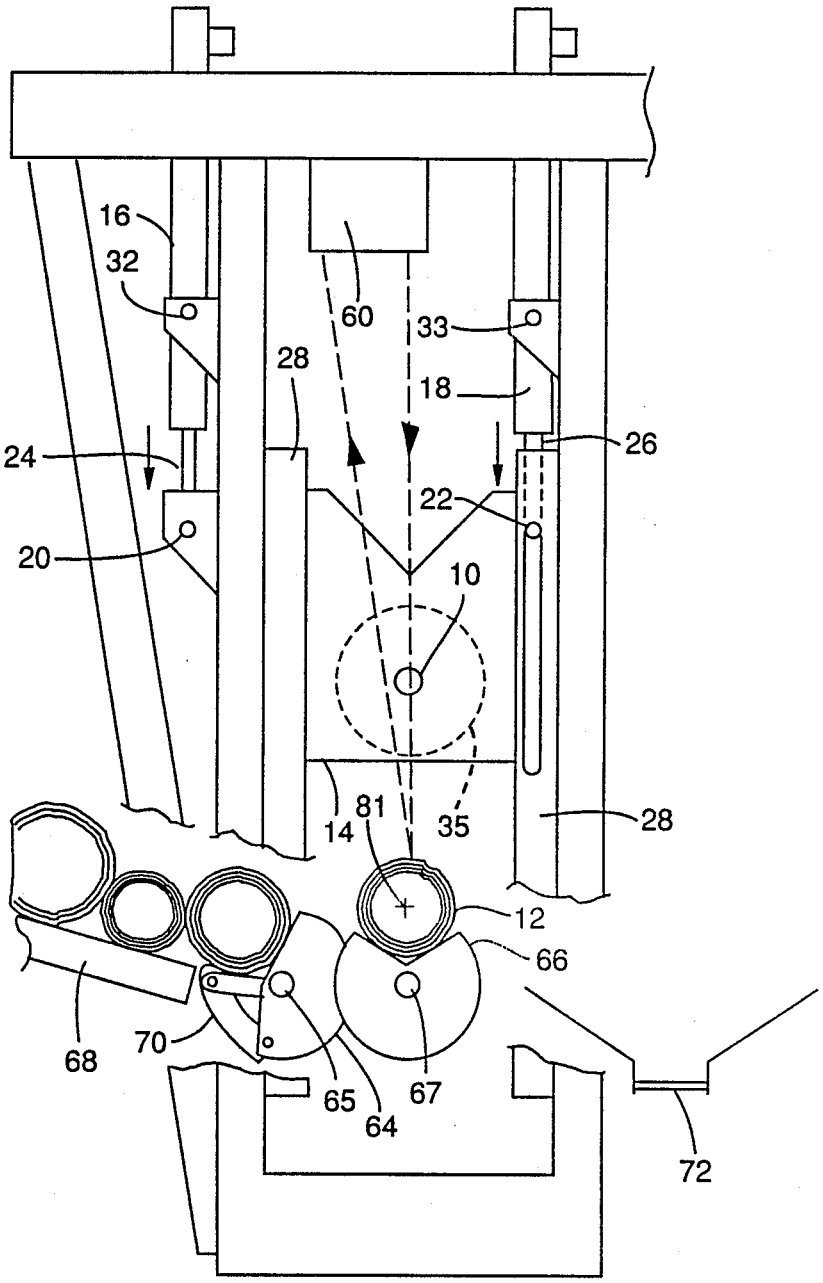
FIGS. 3A to 3D are diagrammatic views showing several steps in the preferred method of operation of the lathe charger apparatus.
Figure 5:
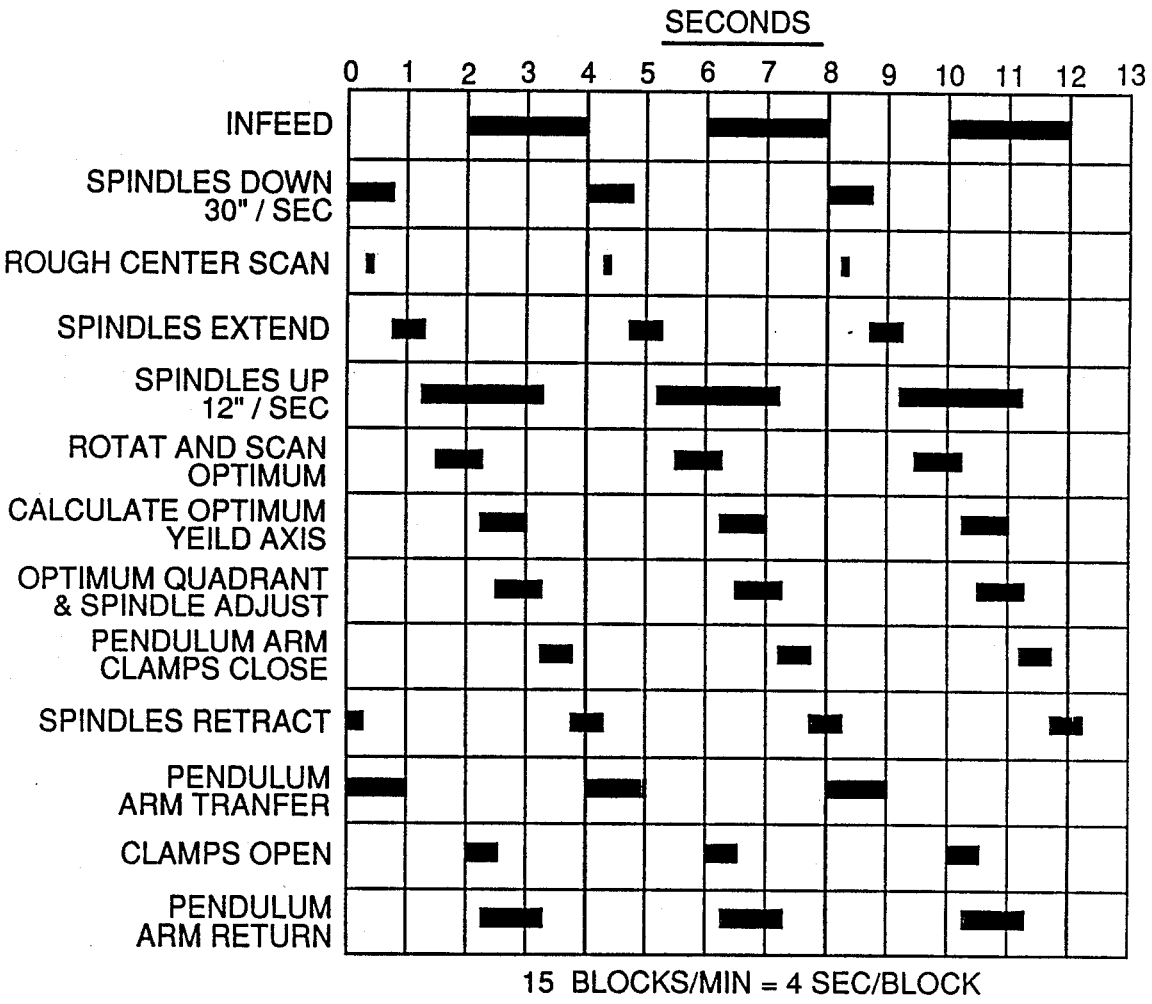
FIG. 5 is a diagrammatic view of the time sequence of the steps in the method of the preferred embodiment of the present invention.

The preferred method of centering a log in a lathe charger, in accordance with the present invention, is shown in FIGS. 3A to 3D and FIG. 5, and is capable of centering a log block in approximately 4 seconds for a production rate of 15 blocks per minute. This method includes an "infeed" step 78 of a 2-second time interval from 2.0 to 4.0 seconds in FIG. 5 which feeds a log block into the charger through the Singulator conveyor 62 so that the log is placed in the rest position shown in FIG. 2. We will consider the method steps of one cycle of the method between the end of the first infeed step 78 and the end of the second infeed step 78'. As soon as the log reaches the rest position, the spindles are caused to start to move downward by movement of the spindle supports 14 in the "spindles down" step 80 which starts at 4.0 and ends at 4.75 seconds. For this spindles down step 80, the spindles travel at a rate of approximately 30 inches per second. During the spindles down time, a "rough center scan" step 82 takes place for about a 0.10 second time period beginning at approximately 4.30 seconds, as shown in FIGS. 3A and 5. Calculation of the rough center axis 81 of the log by the computer from the rough scan data also takes place before the end of the rough scan step 82.

Figure 3B:
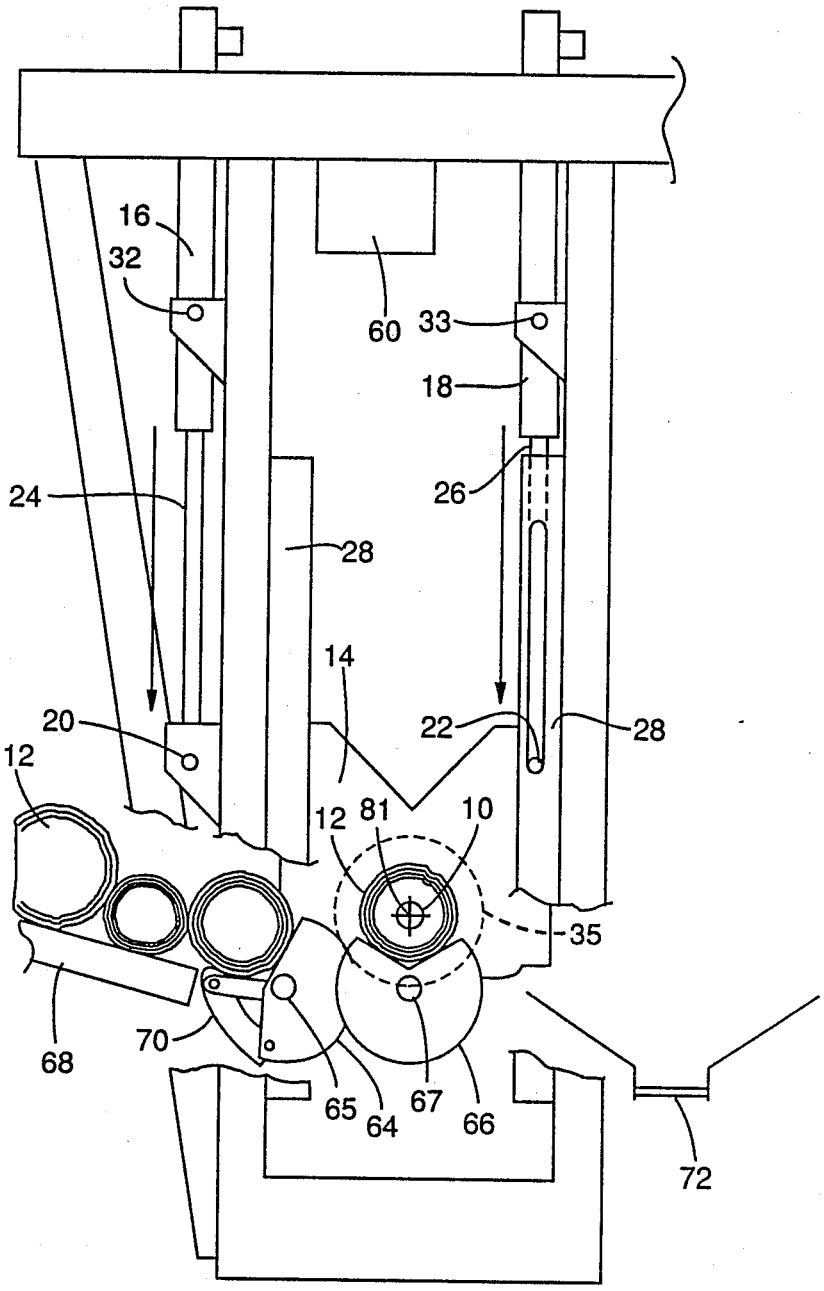
Figure 3C:
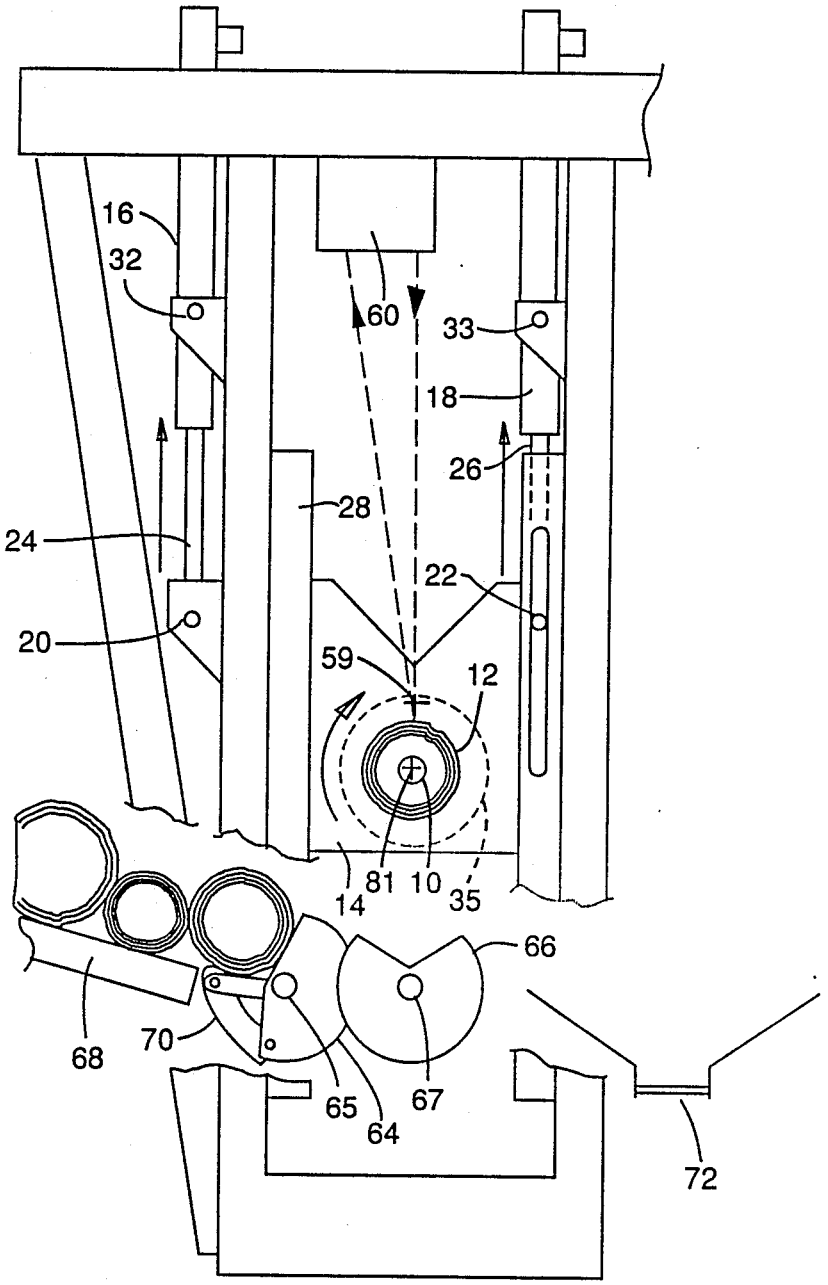

When the spindles reach the full down position into alignment with the approximate center axis of the log in the rest position, the spindles extend into engagement with the opposite ends of the log at such axis during "spindles extend" period 84 as shown in FIGS. 3B and 5. After the spindles engage the log at the approximate center axis 81, such spindles begin moving upward during "spindles up" step 86 which lasts from 5.25 to 7.25 seconds, or a total of 2 seconds at a rate of approximately 12 inches per second. During upward movement of the spindles laterally by step 86, the spindles begin to rotate and the scanners 60 scan the log a second time in a "rotate-and-scan" step 88 which, during the cycle under consideration, lasts from 5.50 to 6.25 seconds, or a period of 0.75 second as shown in FIG. 3C. After this rotate-and-scan step, the computer calculates the optimum yield axis of the log from the scan data in a "calculate" step 90 from 6.25 to 7.0 seconds. During the calculate step, an "optimum quadrant and spindle adjust" step 92 is performed by the computer from 6.50 to 7.25 seconds to orient the spindles in the preferred quadrant and to adjust the position of the lathe spindles in an X-Y direction in order to align the optimum yield axis 59 of the log with the lathe reference axis at the transfer position. This optimum quadrant and spindle adjustment" step 92 ends when the spindles up step 86 terminates, thereby positioning the optimum yield axis at the lathe reference axis 59 in the transfer position. The optimum quadrant and spindle adjustment step includes rotation of the spindles after scanning rotation ceases through an angle less than one complete rotation in order to orient the spindles so that the maximum adjustment distance of the spindles is in a direction which is not toward the transfer arms 38, as more completely described in U.S. Pat. No. 4,383,560 of McGee issued May 17, 1983.

Figure 3D:
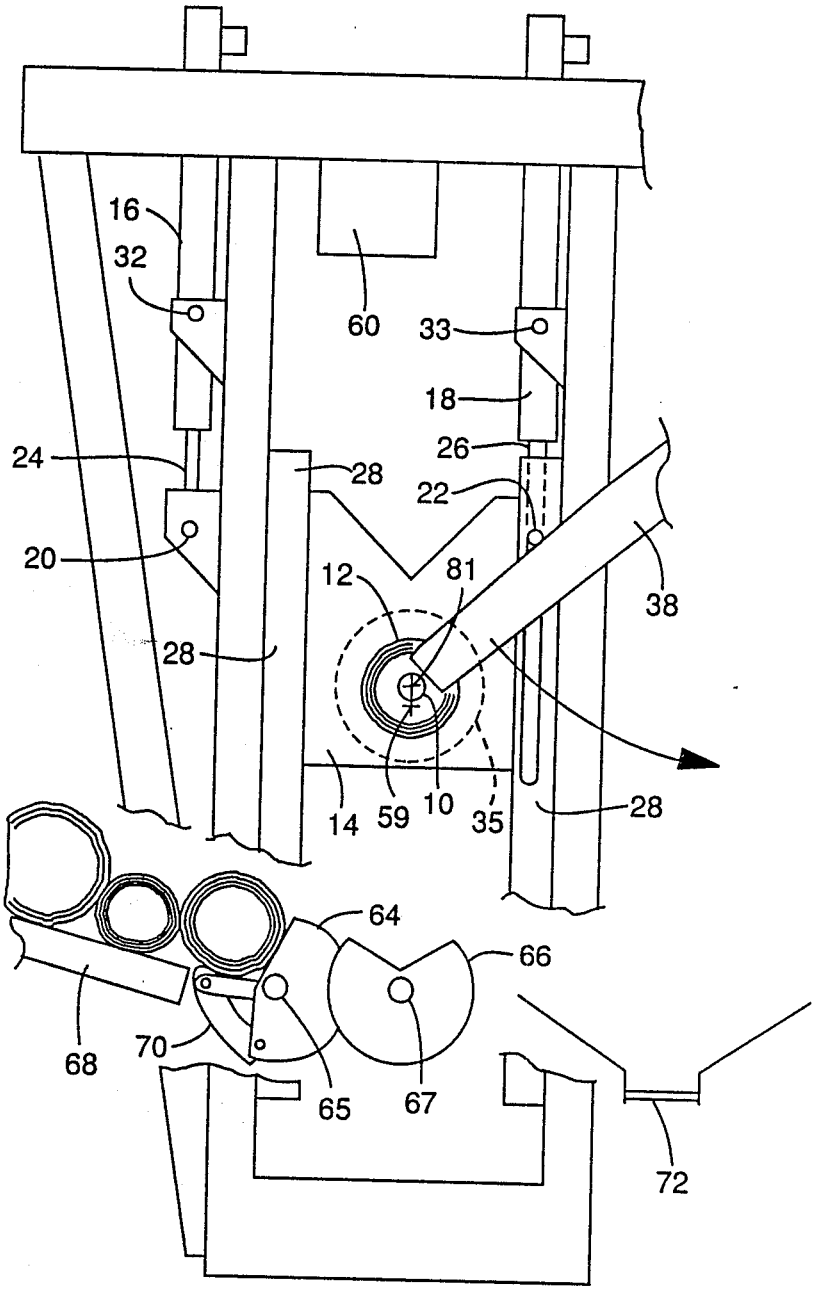

The "pendulum arm clamps close" step 94 from 7.25 to 7.75 seconds is done after the spindle adjustment step 94 is completed to clamp the log between such arms in the transfer position, as shown in FIG. 3D. After such step, the spindles retract from the opposite ends of the log in "spindle retract" step 96 during the time 7.75 to 8.25 seconds. The pendulum arm then moves forward to transfer the log from the transfer position 59 to the lathe axis position 42 during a "pendulum arm transfer"

step 98 in the time period from 8.0 to 9.0 seconds. It should be noted that after the pendulum transfer of the log has proceeded approximately one-third of a second, then the rough center scan step 82' for the next log can take place, since the transfer arms and the previous log are clear of the light path from scanner 60 to the next log waiting on the Singulator output disk 66.

After the pendulum arm transfers the log to the veneer lathe and such log is engaged by the lathe spindles at lathe axis 42, the pendulum arm clamps open in "clamps open" step 100 during the period 10.0 to 10.5 seconds. Then, the pendulum arms return to be loaded in a "pendulum arms return" step 102 during time period 10.25 to 11.25 seconds. It should be noted that during the movement of the pendulum tranfer arm in time periods 98, 100, and 102, the next log is being rough-center scanned in step 80', the spindles are being moved down and extended into engagement in step 82', and the log is being rotated and scanned in step 84', as well as the spindles being moved upward in step 86. Thus, one complete cycle for the lathe charger in processing a log extends for only 4 seconds in the period between 4.00 seconds and 8.00 seconds.

Figure 6:
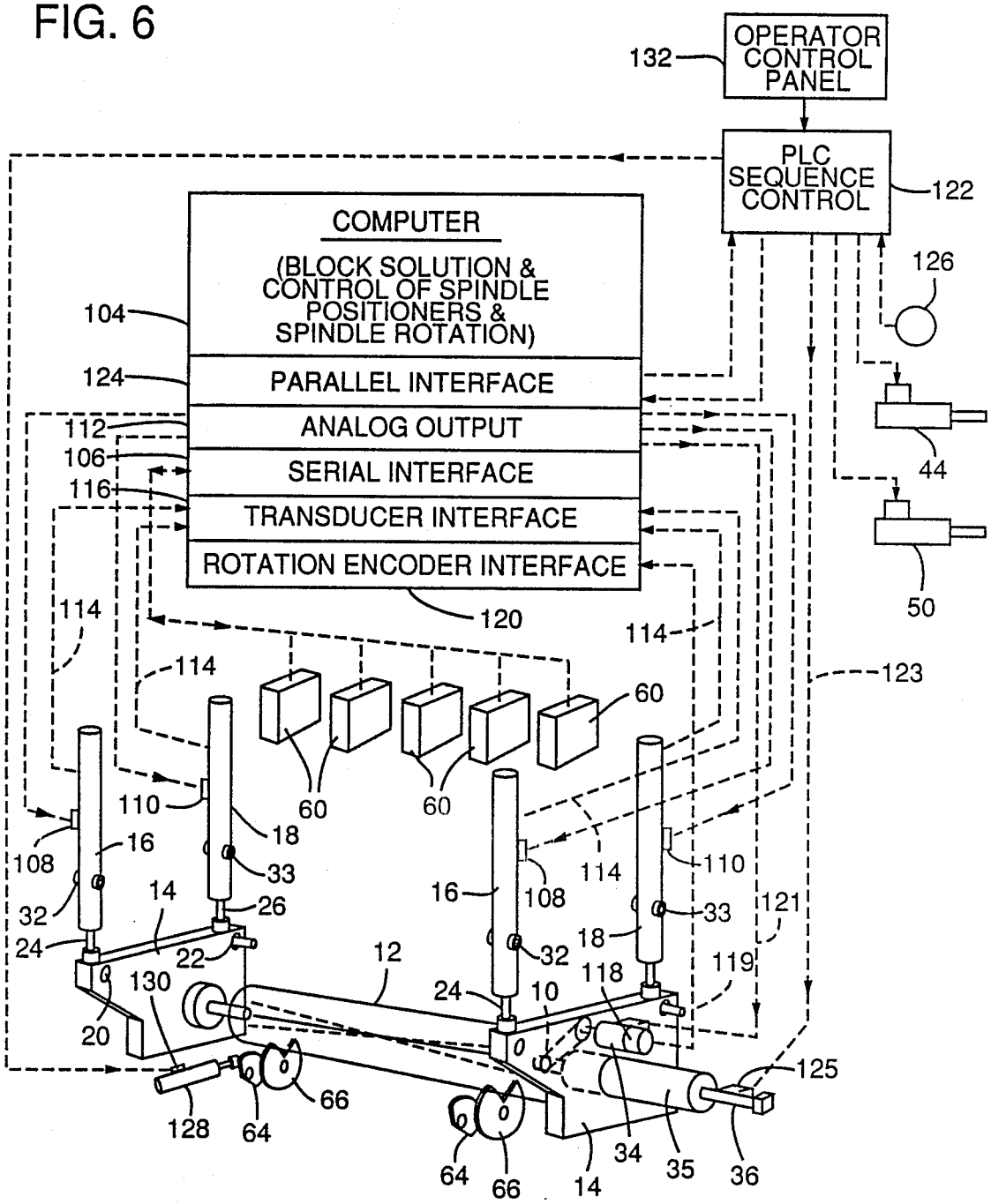
FIG. 6 is a diagrammatic view of a computer control system for the lathe charger apparatus of FIGS. 1 to 3.

As shown in FIG. 6, a computer control system for the lathe charger apparatus includes a general purpose digital computer 104 which is programmed to determine the approximate center axis and the optimum yield axis of the log 12 in response to scanner data and other input information in a conventional manner. The light sensor log scanners 60 are connected to a serial interface circuit 106 of the computer to supply scanner data input signals to the computer when scanning the log in its rest position to determine the approximate center axis of such log and as the log is being rotated to determine its optimum yield axis. Only the two end scanners 60 may be used for rough centering to determine the approximate center axis of the log more rapidly. The longitudinal positioners 16 and 18 each have a servo valve 108 and 110, respectively, which are connected to different outputs of an analog output circuit 112 of the computer that controls the raising and lowering of their piston rods to move the spindle supports 14. The positions of the piston rods of longitudinal positioners 16 and 18 are determined by Temposonic-type transducers in such positioners which transmit corresponding position signals on transducer outputs 114 to a transducer interface 116 of the computer. A spindle shaft encoder 118 is coupled to the spindle 10 driven by hydraulic motor 34 in order to supply a spindle rotation position signal on output 119 to a rotation encoder interface circuit 120 of the computer. The computer uses this spindle rotation position signal to control the spindle motor 34 by an analog output 121 to a servo valve on such motor. A PLC sequence control circuit 122 is connected through sequence signal inputs and outputs of a parallel interface 124 to the computer. The PLC control circuit 122 produces an output 123 which operates a solenoid valve 125 to control spindle cylinder 36 to extend the spindles when spindles are at the rough center axis and to retract the spindles when the log is transferred to pendulum arms 38. In addition, the spindle rotation position signals are used by the computer to control the actuation of the scanners 60 for taking a scan sensor reading every 15 degrees of rotation of the log. The sequence control 122 is also connected at its outputs to the pendulum cylinder 44 to control the pivoting of the transfer arms 38 and to the clamp cylinders 50 for causing the transfer arms to clamp and unclamp the log. In addition, a pendulum arm position encoder 126 is coupled to the transfer arm 38 to supply a rotational arm position signal to the sequence control 122. Such sequence control operates the Singulator log conveyor device 62 in a reciprocating manner by controlling the operation of a Singulator positioning cylinder 128 through a servo valve 130. Also, the sequence control circuit can be controlled by an operator control panel 132. This computer control system controls the lathe charger apparatus of FIGS. 1 to 3 to perform the log centering method of the present invention.

It will be obvious to one having ordinary skill in the art that changes may be made in the above-described preferred embodiment of the invention while maintaining the advantages of such invention. Therefore, the scope of the present invention should be determined by the following claims.

I claim:

1. A method of centering a log in a veneer lathe charger, comprising the steps:

positioning a log in the lathe charger;

rough centering the log on the approximate center axis of said log;

engaging the opposite ends of the log with spindles at the approximate center axis;

rotating the log with said spindles while moving the log laterally toward a transfer position;

scanning the log as it is being rotated and moved toward the transfer position to produce electrical scan data corresponding to the surface configuration of said log;

determining the optimum yield axis of the log from said scan data; and adjustment of the spindles to align the optimum yield axis of the log relative to the transfer position for transfer to the veneer lathe axis.

2. A method in accordance with claim 1 in which the log is scanned with light sensors.

3. A method in accordance with claim 2 in which the log is optically scanned for determining its approximate center axis as the spindles are lowered toward said log in a rest position before rough centering the log, and said log is optically scanned for determining its optimum yield axis as the spindles are raised from said rest position toward said transfer position.

4. A method in accordance with claim 1 in which the spindles are adjusted as the spindles and the log engaged thereby are moved toward the transfer position.

5. A method in accordance with claim 4 in which the spindles are adjusted after the spindles are rotated into a preferred quadrant orientation where maximum adjustment of the spindles is in a direction which is not toward transfer arms which transfer the log to the lathe.

6. A method in accordance with claim 4 in which the spindles are adjusted by pivoting spindle supports with longitudinal positioners.

7. A method in accordance with claim 1 in which the log is separated from a supply of logs and fed into a rest position by an intermittently operating conveyor device.

8. A method in accordance with claim 6 in which the conveyor device separates the log blocks by partial rotation, moves a single log block to a rest position, and removes any rejected block from the rest position to a discharge position by further rotation of said conveyor device.

9. A method in accordance with claim 1 in which the optimum yield axis is determined and the spindles are adjusted by a digital computer control system.

10. A method in accordance with claim 1 in which the scanning is performed by reflection of light beams from the surface of the log.

11. A method of centering a log in a veneer lathe charger, comprising the steps:

positioning a log in the lathe charger at a rest position;

optically scanning said log with light in said rest position to produce first scan data;

determining the approximate center axis of said log from said first scan data;

moving spindles toward said log in said rest position;

engaging the opposite ends of the log with said spindles at the approximate center axis;

moving said spindles and log away from said rest position toward a transfer position while said log is being rotated by said spindles;

optically scanning said log with light as it is being moved toward said transfer position and rotated to produce second scan data;

determining the optimum yield axis of the log from said second scan data; and adjustment of the spindles to align the optimum yield axis of the log relative to the transfer position for transfer to the veneer lathe axis.

12. A method in accordance with claim 11 in which the log is optically scanned for determining its approximate center axis as the spindles are lowered toward said rest position and is optically scanned for determining its optimum yield axis as the spindles and log are raised toward said transfer position from said rest position.

13. A method in accordance with claim 11 in which the spindles are adjusted as the spindles and the log engaged thereby are moved toward the transfer position.

14. A method in accordance with claim 13 in which the spindles are adjusted after the spindles are rotated into a preferred quadrant orientation where maximum adjustment of the spindles is in a direction which is not toward transfer arms which transfer the log to the lathe.

15. A method in accordance with claim 13 in which the spindles are adjusted in two orthogonal directions by pivoting spindle supports with longitudinal positioners.

16. A method in accordance with claim 11 in which the log is separated from a supply of logs and fed into the rest position by an intermittently operated rotating conveyor device which feeds the logs into the lathe charger one at a time.

17. A method in accordance with claim 15 in which the conveyor device removes a rejected block from the rest position to a discharge conveyor device.

18. A method in accordance with claim 11 in which the log is scanned at a plurality of positions spaced along the length of the log.

19. A method in accordance with claim 11 in which the optical scanning is performed by reflection of light beams from the surface of the log.

20. A method in accordance with claim 11 in which the optimum yield axis is determined and the spindles are adjusted by a digital computer control system.

* * * * *